US008858661B2

(12) United States Patent
Kim

(10) Patent No.: US 8,858,661 B2
(45) Date of Patent: Oct. 14, 2014

(54) METHOD AND APPARATUS OF GASIFICATION UNDER THE INTEGRATED PYROLYSIS REFORMER SYSTEM (IPRS)

(76) Inventor: Hyun Yong Kim, Seoul (KR)

( * ) Notice: Subject to any disclaimer, the term of this patent is extended or adjusted under 35 U.S.C. 154(b) by 975 days.

(21) Appl. No.: 12/997,142

(22) PCT Filed: Aug. 1, 2008

(86) PCT No.: PCT/KR2008/004490

§ 371 (c)(1),
(2), (4) Date: Dec. 9, 2010

(87) PCT Pub. No.: WO2009/151180

PCT Pub. Date: Dec. 17, 2009

(65) Prior Publication Data

US 2011/0088321 A1 Apr. 21, 2011

(30) Foreign Application Priority Data

Jun. 12, 2008 (KR) ..... 10-2008-0055035

(51) Int. Cl.
*B01J 7/00* (2006.01)

(52) U.S. Cl.
USPC ..... 48/61; 48/127.9; 48/127.1; 48/197 R; 48/76; 422/630; 422/625

(58) Field of Classification Search
USPC ..... 48/61, 127.9, 197 R, 127.1, 76, 69
See application file for complete search history.

(56) References Cited

U.S. PATENT DOCUMENTS

| | | | | |
|---|---|---|---|---|
| 6,790,383 | B2 | 9/2004 | Kim | |
| 7,556,659 | B2 * | 7/2009 | Kim | 48/61 |
| 2001/0011438 | A1 * | 8/2001 | Fujimura et al. | 48/197 R |
| 2005/0223644 | A1 | 10/2005 | Kim | |
| 2007/0289214 | A1 | 12/2007 | Briesch et al. | |

FOREIGN PATENT DOCUMENTS

| | | |
|---|---|---|
| DE | 36 00 432 | 2/1987 |
| DE | 195 36 383 | 4/1997 |
| JP | 2004-204106 | 7/2004 |

* cited by examiner

*Primary Examiner* — Kaity V. Handal
(74) *Attorney, Agent, or Firm* — Jordan and Hamburg LLP

(57) ABSTRACT

A gasification system reduces volume of a bulky carbonaceous feedstock by pyrolysis to bring about a significant reduction in volume. The system includes a pyrolysis chamber, a reformer, a syngas burner, and a syngas storage tank. Flue gas is provided from the chamber to the reformer. Hot gases are introduced to the reformer from the syngas burner. The pyrolysis reaction occurs in the reformer to produce syngas of at least 1200° C. Some of the produced syngas is used to heat the pyrolysis chamber and the rest returns to the reformer with the flue gas. The syngas burner is situated horizontally at the bottom of the reformer, while the pyrolysis chamber is situated vertically at the top of the reformer. The reformer is inclined relative to each of the syngas burner and the pyrolysis chamber.

2 Claims, 1 Drawing Sheet

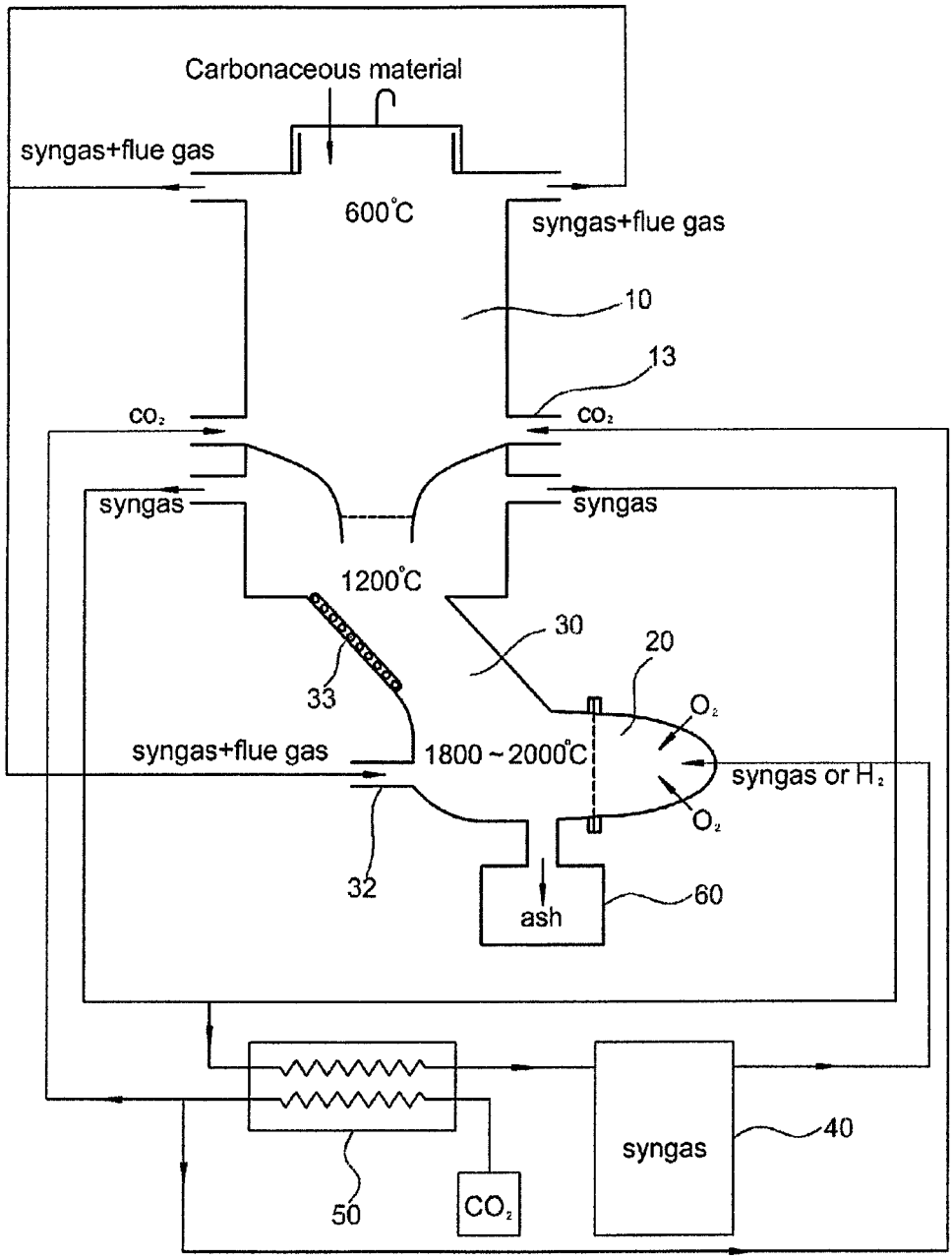
Carbonaceous material
syngas+flue gas
600°C
syngas+flue gas
10
13
$CO_2$
$CO_2$
syngas
syngas
1200°C
30
20
33
$O_2$
syngas+flue gas
1800 ~ 2000°C
syngas or $H_2$
$O_2$
32
ash
60
syngas
40
50
$CO_2$

METHOD AND APPARATUS OF GASIFICATION UNDER THE INTEGRATED PYROLYSIS REFORMER SYSTEM (IPRS)

TECHNICAL FIELD

The present invention integrates pyrolysis and reformer into a single system so that bulky carbonaceous feed stock is pyrolyzed at low temperature (600~1000° C.) and reform pyrolysis products, flue gas and solid char/cokes in the high temperature reformer operating at 1200° C.; all carbon atoms are effectively reformed into CO gas and hydrogen atoms reduced to hydrogen gas.

BACKGROUND ART

In conventional pyrolysis, bulky carbonaceous feedstock is partially combusted to raise the temperature of feedstock (partial oxidation method) and consequently to produce gas and solid char/cokes. The flue gas is combusted in the second stage reactor, and the heat generated is put back into the first stage to further increase the temperature for pyrolysis. The remnant solid disposed in the solid disposal dump.

More recently, it has been reported that the combustion of flue gas with $O_2$ gas, is used to gasify solid char/coke into syngas (DE 19536383-A1). Flue gas is a mixture of gases, some of them quite toxic, need to be combusted in the second stage reactor, before it can be let out into the atmosphere.

DISCLOSURE OF INVENTION

Technical Problem

In a conventional pyrolysis-gasification reactor, flue gas is combusted to provide heat for pyrolysis and also heat for gasifying solid char/cokes. However the highest temperature attained from combustion of flue gas is reported to be 1650° C. This is hardly high enough to maintain the gasifier temperature above 1200° C. And little syngas were produced. In order to introduce bulky feedstock into gasifier or reformer maintained at 1200° C. and above, large heat loss is accompanied. Bigger the reformer, the heat loss is greater and harder to maintain 1200° C. temperature. The applicant has discovered that the carbon reforming reaction proceeds at 1200° C. and above without catalyst, and published it in IJHE (Int'l J. of Hydrogen Energy, vol. 28 pp. 1179~1186 (2003), A low cost production of hydrogen from carbonaceous wastes) and Korea

Technical Solution

As it is described above, the objective of this invention is that bulky carbonaceous material is pyrolyzed at the lower temperature of 600~1000° C., and the pyrolysis products, flue gas and char/cokes are reformed effectively in a compact reformer to maximize syngas production. In order to minimize heat loss, the reformer is designed to be as compact as possible. Bulky carbonaceous feedstock needs to be downsized to fit into the compact reformer.

Advantageous Effects

According to the present invention, a bulky carbonaceous feedstock is pyrolyzed at lower temperature (600~1000° C.) to bring about a significant reduction in it's volume, and the pyrolysis products are transferred into a smaller reformer at 1200° C. to carry out an efficient conversion to syngas. Carbonaceous material constitutes all forms of carbon-containing substance and it includes all fossil fuel, biomass, marine vegetation, animal waste, and industrial organic wastes. No catalyst is needed.

In order to force this reduction reaction, the temperature of the reformer must be maintained at 1200° C. and above. In so doing, the reformer furnace contends with substantial heat loss, and heat loss is greater as the reformer gets bigger in size. Therefore, it is desirable to reduce the volume of feedstock in the pyrolysis reactor at low temperature (600~1000° C.) and gasify the reduced pyrolysis products in a compact reformer. Pyrolysis reduces it's volume to less than 1/10 of the feedstock. Pyrolysis flue gas flows continuously.

In the present system, there is no $O_2$ gas enter into the pyrolysis chamber nor the reformer. And there is no combustion (oxidation reaction) of feedstock any where in the system.

BRIEF DESCRIPTION OF THE DRAWINGS

The above and other objective, features and other advantages of the present invention will be more clearly understood from the following detailed description taken in conjunction with the accompanying drawings, in which:

FIG. 1 is a schematic diagram illustrating an apparatus of gasification under the Integrated Pyrolysis Reformer System (IPRS).

BEST MODE FOR CARRYING OUT THE INVENTION

The present invention, an apparatus of gasification under the Integrated Pyrolysis Reformer System (IPRS) as shown in FIG. 1 is to gasify bulky carbonaceous feedstock to produce syngas. A method of gasification under the IPRS comprises the first stage of introducing bulky feedstock into a pyrolysis chamber (10) to produce pyrolysis gas (flue gas); the second stage of introducing pyrolysis gas (flue gas) into a reformer (30), and introducing hot gases (steam or steam and $CO_2$ gas) generated from the combustion of hydrogen gas or syngas with $O_2$ gas into the reformer (30); and the third stage of reacting pyrolysis gas (flue gas) with the hot gases in the reformer (30) to produce syngas. This is in contrast to the conventional method in which feedstock is combusted with $O_2$ gas. This last stage includes reforming pyrolysis gas (flue gas) routed from the pyrolysis chamber (10) and charred remains of pyrolysis entering at the top of reformer (30).

In the above method a portion of syngas reformed at 1200° C. enter into pyrolysis chamber (10) and maintain the chamber temperature at 600~1000° C., and syngas that went through the pyrolysis chamber (10) returns to the reformer (30) with flue gas. The rest of syngas generated enter into storage tank (40) thru a heat exchanger (50), and a portion recycled to the syngas burner (20) to generate more hot gases.

A portion of syngas produced in the reformer (30) is continuously recycled through pyrolysis chamber (10) and maintains its temperature at 600~1000° C., and the rest recycles through the storage tank (40) and the syngas burner (20) and generates more hot gases to maintain the reformer temperature at 1200° C. and above. As it recycles, it pyrolyzes more carbonaceous feedstock and accumulates more syngas in the storage tank. And the final inorganic remains are collected as ash trap (60).

Therefore, the method of gasification under the IPRS of the present invention consists of two syngas recycling passages; one is the reformer-pyrolysis chamber-reformer; the other is the reformer-storage tank-syngas burner-reformer. The first passage transports thermal energy to the pyrolysis chamber (10), and transport flue gas back into the reformer (30); and the second passage thru the syngas burner (20) generates more hot gases to maintain the reformer temperature at 1200° C.

The apparatus of gasification under the IPRS comprises the pyrolysis chamber (10) to supply pyrolysis gas (flue gas) to the reformer (30); the syngas burner (20) for introducing hot gases (steam or steam and carbon dioxide gases) generated from combusting hydrogen gas or syngas with oxygen gas into the reformer (30); and the reformer (30) reacting pyrolysis gas (flue gas) with hot gases to produce syngas, wherein a portion of syngas produced in the reformer (30) is used to heat the pyrolysis chamber (10), and the rest of syngas produced go thru heat exchanger (50) and into the syngas storage tank (40), and syngas that went through the pyrolysis chamber (10) returns to the reformer (30) with pyrolysis gas (flue gas).

The reformer (30) is situated below the pyrolysis chamber (10) and the syngas burner (20) is located horizontally at the lower part of the reformer (30). The oxygen gas supplied into the syngas burner (20) is less than full amount, such that oxygen gas is fully consumed. The reformer (30) is inclined about 60° with the horizontal syngas burner (20) and makes 30° with the vertically situated pyrolysis chamber (10), this is designed to slow free falling char from the pyrolysis chamber (10) into the reformer (30). One could consider other devices such as moving belt, or roller (33).

The pyrolysis chamber (10) is a top loading device as shown in FIG. 1. Syngas, steam and carbon dioxide gases at 1200° C. enter the bottom of the pyrolysis chamber (10) from the reformer (30), and heat the entire chamber and maintain the temperature of 600~1000° C. Pyrolyzed flue gas with syngas are routed into the reformer (30) thru input port (32). Pyrolyzed char just fall on the roller (33) of the reformer (30). A portion of stored syngas is routed into the syngas burner (20), and combusted with $O_2$ gas. Syngas combustion products, steam and $CO_2$ gas at 1800~2000° C., enter into the reformer (30) and maintain its temperature at least 1200° C. The flue gas and the char of the pyrolysis products are reformed, there is no combustion of feedstock nor pyrolysis products. In this invention, only syngas is combusted in the syngas burner (20) to produce hot gases to maintain the reformer temperature at 1200° C., and a portion of product syngas at 1200° C. enter into pyrolysis chamber (10) to maintain it's temperature at 600~4000° C. The rest of product syngas goes through the heat exchanger (50) and stored in storage tank (40).

Feedstock is normally shredded and packed to reduce air pockets. There is preheated $CO_2$ gas to flush out air trapped in feedstock thru input port (13).

The present invention incorporate applicant's previous technology of high temperature reformer (KR Pat. 637340, US Pat. 2005-0223644-A1) with pyrolysis technology (prior art) of redwing bulky feedstock down to about ~10% of original volume, and reforming both flue gas and charred remnants into syngas. Ugh efficiency is maintained by keeping the size of the reformer compact and efficient. The IPRS is the most suitable for gasifying bio-mass including marine vegetations and municipal wastes.

INDUSTRIAL APPLICABILITY

Pyrolysis reaction at 600~1000° C. produces $C_1$~$C_8$ flue gas and solid char and cokes. Reforming reaction here is more specifically defined as that carbon atom reacts with steam or carbon dioxide gas at 1200° C. and reforms into CO gas and all hydrogen atoms are reduced to $H_2$ gas. It is also referred as endothermic reduction reaction. Irregardless of physical and chemical states of carbon, it reacts with steam or $CO_2$ gas at 1200° C. and above, and reforms into CO and $H_2$ gas, called syngas. No catalyst is needed.

This technology is applicable to the waste-to-energy conversion process and a wide variety of bio-mass conversion to syngas.

The invention claimed is:

1. A gasification apparatus under an integrated pyrolysis reformer system (IPRS) comprising:

a pyrolysis chamber connected to a reformer to supply pyrolysis gas (flue gas) to the reformer;

a syngas burner for introducing steam or steam and carbon dioxide gases generated from combusting hydrogen gas or syngas with oxygen gas into the reformer; and the reformer reacting pyrolysis gas (flue gas) with steam or steam and carbon dioxide gases to produce syngas; and wherein the syngas burner is situated horizontally at the bottom of the reformer, while the pyrolysis chamber is situated vertically at the top of the reformer, and the reformer is inclined 60° with the horizontal syngas burner and 30° with the vertically situated pyrolysis chamber, and wherein a portion of syngas produced in the reformer is used to heat the pyrolysis chamber and return to the reformer with the flue gas, and the rest of the syngas produced flows through a heat exchanger and into a syngas storage tank.

2. The apparatus of claim 1, wherein the syngas produced in the reactor has a temperature of at least 1200° C.

* * * * *